US008516848B2

(12) United States Patent
White et al.

(10) Patent No.: US 8,516,848 B2
(45) Date of Patent: Aug. 27, 2013

(54) PLATFORM INSERT FOR PORTABLE COOLER

(76) Inventors: Richard W. White, Lake Worth, FL (US); Robert J. White, Lake Worth, FL (US)

( * ) Notice: Subject to any disclaimer, the term of this patent is extended or adjusted under 35 U.S.C. 154(b) by 342 days.

(21) Appl. No.: 13/068,815

(22) Filed: May 20, 2011

(65) Prior Publication Data

US 2011/0289958 A1 Dec. 1, 2011

Related U.S. Application Data

(60) Provisional application No. 61/396,705, filed on Jun. 1, 2010.

(51) Int. Cl.
*F25D 3/08* (2006.01)

(52) U.S. Cl.
USPC ..... 62/457.1; 62/465

(58) Field of Classification Search
USPC ..... 62/465, 371, 372, 457.1, 457.2, 457.3, 62/457.7; 220/23.87, 23.89, 915.2; 312/351, 312/404
See application file for complete search history.

(56) References Cited

U.S. PATENT DOCUMENTS 3,873,114 A * 3/1975 Brown ..... 280/30
3,961,496 A * 6/1976 Ku ..... 62/459
4,131,196 A * 12/1978 Csutor ..... 206/278
4,194,647 A * 3/1980 Spurrier ..... 221/97
4,213,310 A * 7/1980 Buss ..... 62/457.2
4,347,713 A 9/1982 Morrison
4,515,421 A * 5/1985 Steffes ..... 312/351
4,581,902 A * 4/1986 Starck et al. ..... 62/258
4,696,412 A * 9/1987 McGowan et al. ..... 220/832
4,697,380 A * 10/1987 Fenske ..... 43/55
4,889,257 A * 12/1989 Steffes ..... 220/815
4,910,975 A 3/1990 Derby
5,263,338 A * 11/1993 Banks ..... 62/331
5,295,369 A * 3/1994 Garcia ..... 62/389
5,319,937 A * 6/1994 Fritsch et al. ..... 62/3.62
5,437,165 A 8/1995 White
5,606,871 A * 3/1997 Hansen et al. ..... 62/457.5
5,685,165 A * 11/1997 Bigelow, Jr. ..... 62/420
5,931,019 A 8/1999 White
6,269,965 B1 8/2001 White
6,626,006 B1 * 9/2003 Tedder ..... 62/457.7
7,162,890 B2 1/2007 Mogil

* cited by examiner

*Primary Examiner* — Mohammad M Ali
(74) *Attorney, Agent, or Firm* — Alvin S. Blum

(57) ABSTRACT

A liner of a cooler has sides extending upward to an inner shoulder. A platform assembly fits onto the inner shoulder of the cooler. The assembly provides a sanitary platform for ready access to ice cubes and/or cooled items below, a scoop for the ice, a lid(s) for closing the aperture(s) so that the larger cooler cover need not be opened and closed while dispensing cubes during drink or meal preparation. An aperture receives a container held by its rim for an ice scoop. The lid is provided with a tongue adapted to fit into a slot in the platform so as to enable the lid to stand upright out of the way when the aperture is open to receive or dispense cubes. A second aperture and lid may be provided for food/drink items with a partition to separate the items from the ice.

3 Claims, 5 Drawing Sheets

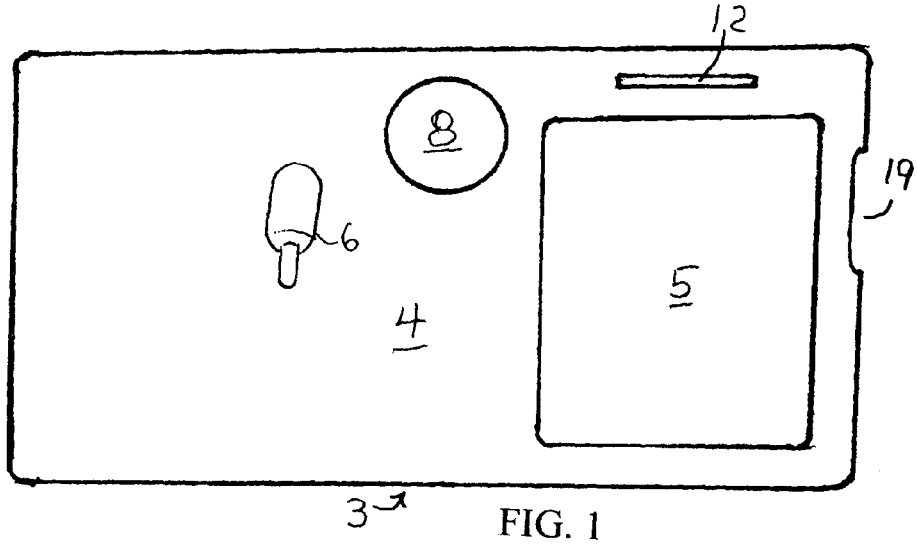
FIG. 1
FIG. 2
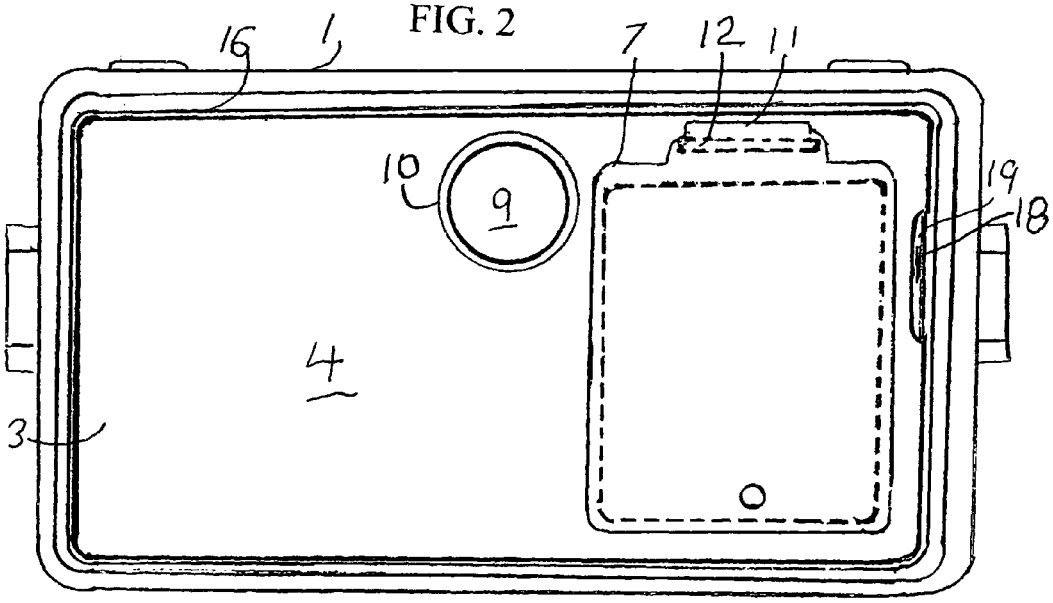

PLATFORM INSERT FOR PORTABLE COOLER

This application claims the benefit of provisional application Ser. No. 61/396,705, filed Jun. 1, 2010, incorporated herein by reference.

FIELD OF THE INVENTION

This invention relates generally to portable coolers or insulated ice chests, and more particularly to a cooler insert assembly that fits onto a cooler shoulder to provide a work platform for handling food and drink items while holding an ice scoop with access to the ice below.

BACKGROUND OF THE INVENTION

Portable insulated containers are commonly used to hold ice cubes and to keep food and beverages cold. It would be useful if the same cooler could also serve as a sanitary platform on which to dispense drinks and add ice cubes to them. It would also be useful if the platform could also be used to prepare food such as sandwiches. It would also be useful if the platform assembly could be easily sanitized.

SUMMARY OF THE INVENTION

It is accordingly an object of the invention to provide an insulated cooler having a hinged insulated cover and an insert assembly for a cooler that provides a sanitary platform with an aperture for ready access to the ice cubes, a scoop for the cubes, a lid for closing the aperture so that the larger cooler cover need not be opened and closed while dispensing cubes during drink or meal preparation, a circular aperture in the platform adapted to receive and hold a container by its rim, the container adapted to receive the scoop. The lid is provided with a tongue adapted to fit into a slot in the platform so as to enable the lid to stand upright out of the way when the aperture is open to receive or dispense cubes. The cooler has an inner liner with vertical sides extending upward from a horizontal bottom to an inner shoulder at the upper portion of the cooler. The platform is adapted to fit onto the inner shoulder of the cooler. The assembly is adapted to be securely covered when the cooler cover is closed. There are no hinges connecting elements of the assembly to facilitate sanitizing the assembly.

BRIEF DESCRIPTION OF THE DRAWINGS

FIG. 1 is a top view of the insert assembly without the lid.

FIG. 2 is a top view of the insert in place in a cooler with lid in place.

DETAILED DESCRIPTION OF PREFERRED EMBODIMENTS

Figure 3:
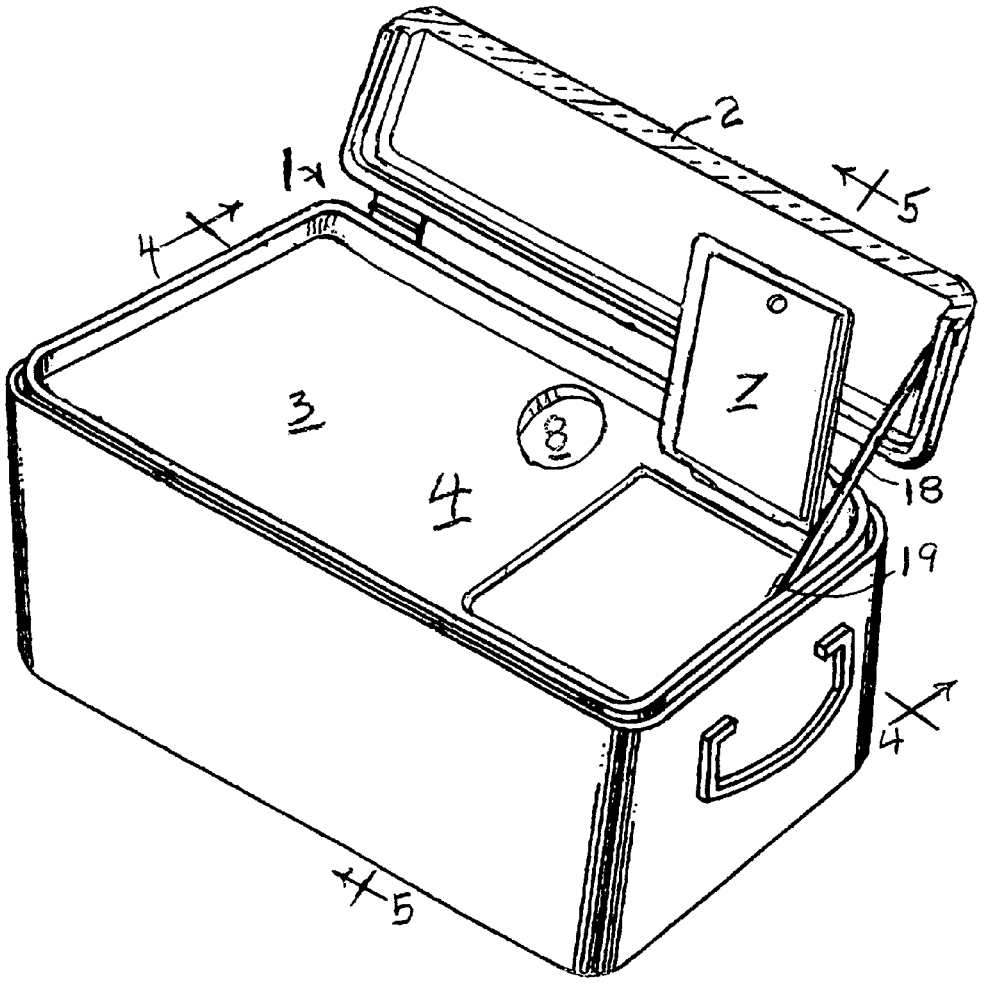
FIG. 3 is a perspective view of an insert assembly in place in a cooler with lid in open mode.
Figure 4:
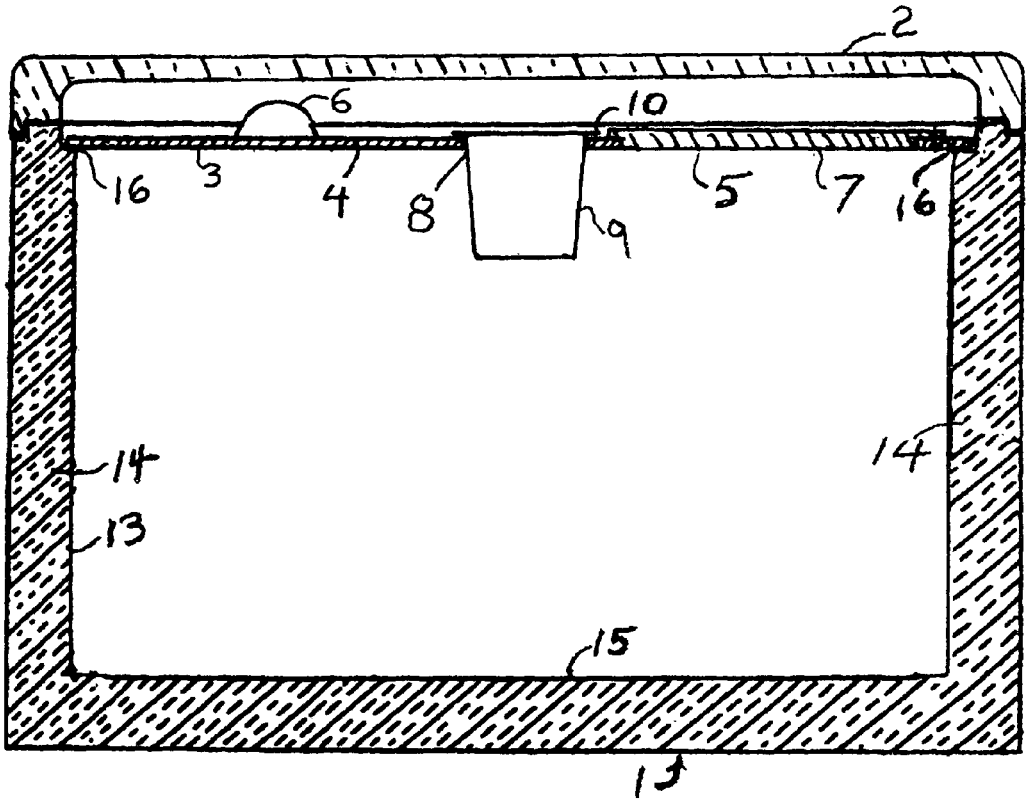
FIG. 4 is a sectional view through line 4-4 of FIG. 3 with lid and cooler closed.
Figure 5:
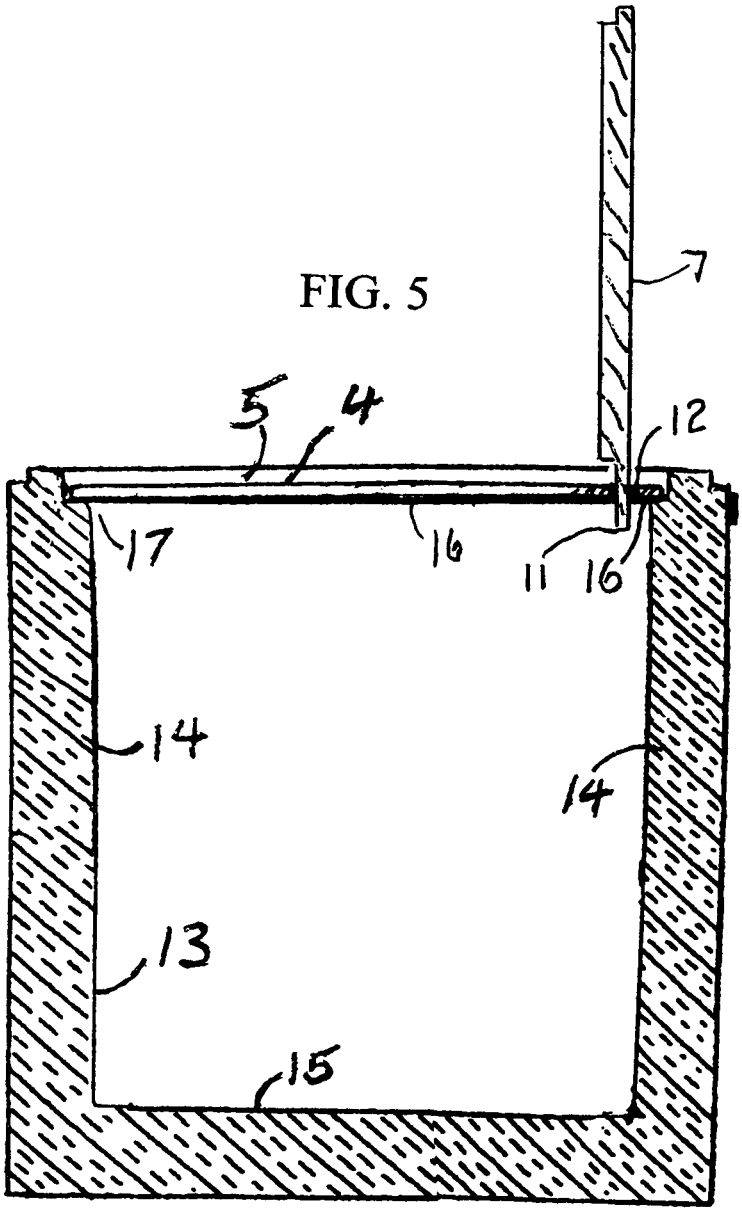
FIG. 5 is a sectional view through line 5-5 of FIG. 3 with lid open.

Referring now to the drawing FIGS. 1-5, an insulated ice chest, or cooler, 1 has a hinged insulated cover 2. The cooler has an inner liner 13 with vertical sides 14 extending upward from a horizontal bottom 15 to an inner shoulder 16 at the upper portion 17 of the cooler. A planar platform 4 is adapted to fit onto the inner shoulder 16 of the cooler. The insert assembly 3 of the invention may include an ice scoop 6, a circular aperture 8 in the platform adapted to receive and hold a container 9, such as a cup or a perforated cup by its rim 10. The container is adapted to receive the scoop. A through aperture 5 in the platform is provided for ready access to the ice cubes. A lid 7 opens and closes the aperture so that the larger cooler cover need not be opened and closed while dispensing cubes during drink or meal preparation. The lid 7 is provided with a tongue 11 adapted to fit into a slot 12 in the platform so as to enable the lid to stand upright out of the way when the aperture is open to receive or dispense cubes or stored items. The insert assembly is adapted to be securely covered when the cooler cover 2 is closed. This provides a secure and sanitary work platform for preparation and dispensing of food and drink that is in one piece for transport. A strap 18 connecting the body of the cooler 1 to the cooler cover 2 will hold the cover in the open position shown in FIG. 3. A cut out 19 in the platform provides for unobstructed function of the strap 18.

Figure 7:
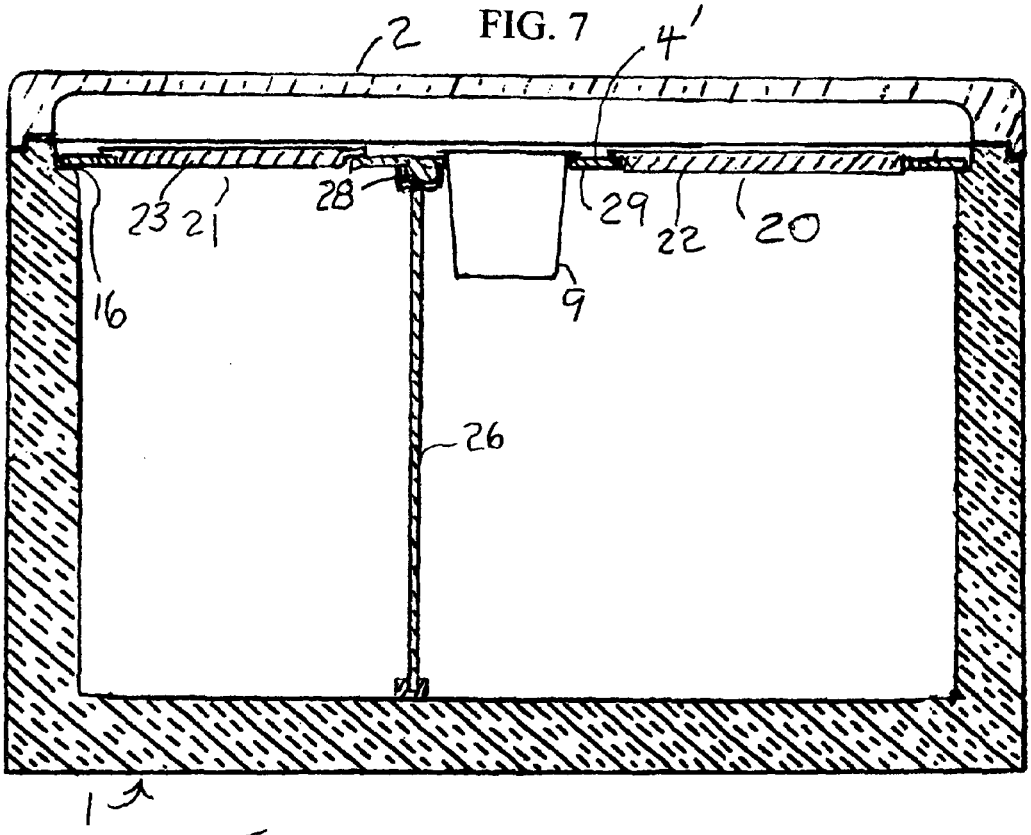
FIG. 7 is a sectional view through line 7-7 of FIG. 6.
Figure 6:
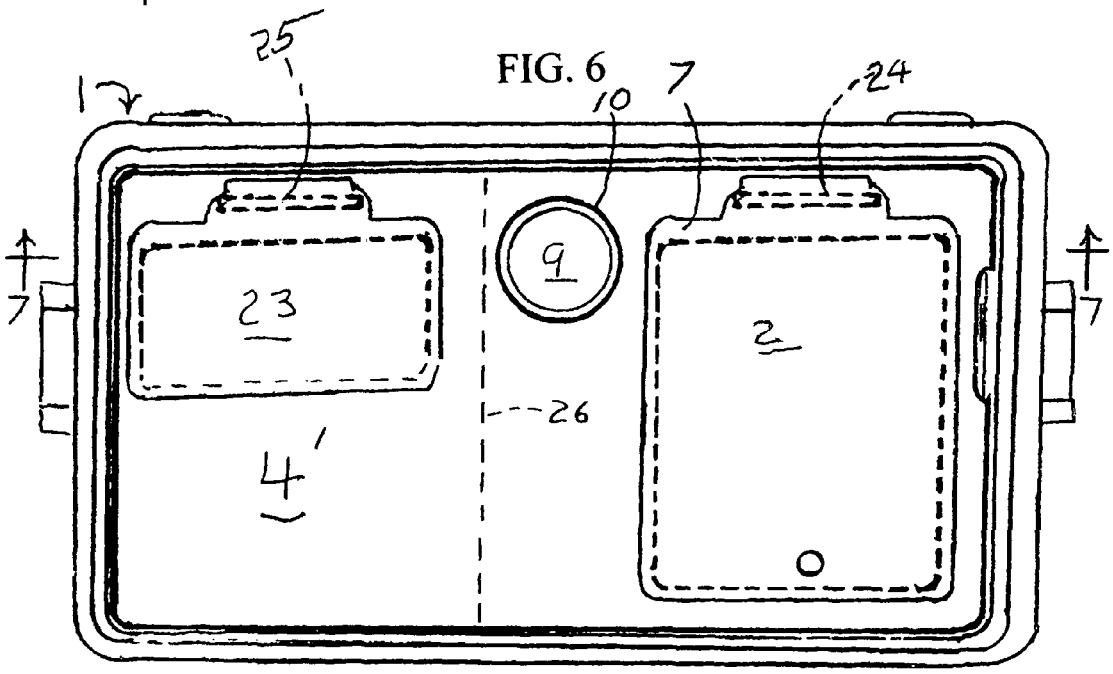
FIG. 6 is a top view of another embodiment of the invention.

Referring now to FIGS. 6 and 7, the platform 4' may be provided with two covered apertures 20 and 21 with removable covers 22 and 23 that fit in slots 24 and 25 in the manner shown above. A partition 26 removably affixed to the underside 29 of platform 4' may divide the cooler 1 into two parts, so that the ice may be kept separate from the food and/or drink, while providing convenient access to both compartments. The means for removably affixing the partition 26 may include, for example, magnets 28 set flush with the surfaces for ease of cleaning. Other removable affixing means well known in the art may be used as well.

While we have shown and described the preferred embodiments of our invention, it will be understood that the invention may be embodied otherwise than as herein specifically illustrated or described, and that certain changes in form and arrangement of parts and the specific manner of practicing the invention may be made within the underlying idea or principles of the invention.

The invention claimed is:

1. A rigid platform insert assembly to be removably installed in a portable ice chest or cooler for preparation and dispensing of food and drink, said cooler having an inner liner with four vertical sides extending upward from a horizontal bottom to a shoulder at the upper portion of the cooler, the cooler having an upper edge that is provided with a hinged insulated closure that is held open by a strap connecting the closure to the inner liner, the insert assembly comprising:

- a rigid rectangular planar platform adapted to fit onto all four sides of the shoulder;
- a circular through first aperture in the platform having a certain diameter;
- a container adapted to fit into the circular aperture, the container having an extended horizontal rim greater than said certain diameter adapted to hold the container in the first aperture by the rim; the container adapted to receive a scoop for ice cubes;
- a rectangular through second aperture in the platform large enough to enable access to ice cubes below the platform;
- a lid for the second aperture having an upper layer large enough to cover the aperture, and a lower layer dimensioned to fit into the aperture;

a slit in the platform adjacent the second aperture adapted for receiving a tongue portion of the upper layer to hold the lid vertically when access through the aperture is desired; and a cutout on a side of the platform for passage of the strap when the lid is held open.

2. A rigid platform insert assembly to be removably installed in a portable ice chest or cooler for preparation and dispensing of food and drink, said cooler having an inner liner with four vertical sides extending upward from a horizontal bottom to a shoulder at the upper portion of the cooler, the cooler having an upper edge that is provided with a hinged insulated closure that is held open by a strap connecting the closure to the inner liner, the insert assembly comprising:

a rigid rectangular planar platform adapted to fit onto all four sides of the shoulder;

a circular through first aperture in the platform having a certain diameter;

a container adapted to fit into the circular aperture, the container having an extended horizontal rim greater than said certain diameter adapted to hold the container in the first aperture by the rim; the container adapted to receive a scoop for ice cubes;

a rectangular through second aperture in the platform large enough to enable access to ice cubes below the platform;

a lid for the second aperture having an upper layer large enough to cover the aperture, and a lower layer dimensioned to fit into the aperture;

a slit in the platform adjacent the second aperture adapted for receiving a tongue portion of the upper layer to hold the lid vertically when access through the aperture is desired; and a rectangular through third aperture in the platform large enough to enable access to items below the platform;

a lid for the third aperture having an upper layer large enough to cover the third aperture, and a lower layer dimensioned to fit into the third aperture;

a slit in the platform adjacent the third aperture adapted for receiving a tongue portion of the upper layer to hold the lid vertically when access through the aperture is desired; and a cutout on a side of the platform for passage of the strap when the lid is held open.

3. The rigid platform assembly of claim 2 further comprising a partition removably affixed to an underside of the planar platform constructed to divide the portion of the cooler below the platform into two separate chambers with one of the rectangular apertures above each chamber.

* * * * *